United States Patent [19]

Tanaka

[11] 3,956,778

[45] May 18, 1976

[54] PORTABLE URINE DISPOSAL DEVICE

[76] Inventor: Yuji Tanaka, 16-411, 3-chome, Aoto, Katsusika, Tokyo, Japan

[22] Filed: June 5, 1975

[21] Appl. No.: 584,162

[52] U.S. Cl. ..... 4/110; 4/142

[51] Int. Cl.[2] ..... A47K 11/02; E03D 13/00

[58] Field of Search ..... 4/110, 111, 112, 99, 4/142, 138, 141; 128/2 F, 275, 283, 294, 295

[56] References Cited

UNITED STATES PATENTS

| | | | |
|---|---|---|---|
| 901,134 | 10/1908 | Weidl | 4/110 X |
| 3,095,578 | 7/1963 | Stanford | 4/110 |
| 3,164,186 | 1/1965 | Weber et al. | 4/110 X |
| 3,403,410 | 10/1968 | Benzel et al. | 4/110 |
| 3,609,771 | 10/1971 | Avoy | 4/113 |
| 3,718,431 | 2/1973 | Wild | 4/112 |

FOREIGN PATENTS OR APPLICATIONS

| | | | |
|---|---|---|---|
| 696,491 | 9/1953 | United Kingdom | 4/110 |
| 264,553 | 1/1950 | Switzerland | 4/142 |

*Primary Examiner*—Henry K. Artis
*Attorney, Agent, or Firm*—Holman & Stern

[57] ABSTRACT

A portable urine disposal device comprising a flexible bellows-shaped main body including the closed bottom and the flared open upper end and including a plurality of pleat units, a diametrically opposite handles in the periphery of said flared open upper end, a plurality of annular members provided within said bellows-shaped main body with the outer periphery of said annular members integrally connected to the inner periphery of the junctures between the adjacent pleat units of said main body, the width of said annular members decreasing toward said flared open upper end and the diameter of the center openings in the annular members increasing toward the flared open upper end, a binding string placed about the outer periphery of the juncture between two selected pleat units of the main body and a stopper ring slidably receiving the folded portions of said binding string.

8 Claims, 2 Drawing Figures

PORTABLE URINE DISPOSAL DEVICE

BACKGROUND OF THE INVENTION

This invention relates to a portable urine disposal device which is suitably used in any place where no permanent urinal facility is available.

SUMMARY OF THE INVENTION

One principal object of the present invention is to provide a portable urine disposal device having a bellows-shaped main body which can be extended to the operation position and retracted to the stowage position.

Another object of the present invention is to provide a portable urine disposal device which is provided with seal means to prevent urine received in the device from flowing out of the device as the device is carried about.

Another object of the present invention is to provide a portable urine disposal device which has handle means by which the device is slung when the device is used.

A further object of the present invention is to provide a portable urine disposal device which is provided with urine retention means by which urine received in the device is prevented from flowing out even when the device is somewhat tilted with one open upper end left unsealed.

According to the present invention, there has been provided a portable urine disposal device which comprises in combination a flexible bellows-shaped main body having the closed bottom and the flared open upper end, a plurality of annular members each having the outer periphery integrally connected to the reduced diameter inner periphery of the juncture between each two adjacent pleat units in the upper portion of said bellows-shaped main body adjacent to said flared upper end and a binding string placed about the outer periphery of the juncture between two selected pleat units of the bellows-shaped main body.

The above and other objects and attendant advantages of the present invention will be more readily apparent to those skilled in the art from a reading of the following detailed description in conjunction with the accompanying drawing which shows one preferred embodiment of the present invention for illustration purpose only, but not for limiting the scope of the invention in any way.

BRIEF DESCRIPTION OF THE DRAWING

The accompanying drawing shows one preferred embodiment of portable urine disposal device constructed in accordance with the present invention in which.

PREFERRED EMBODIMENT OF THE INVENTION

Figure 1:
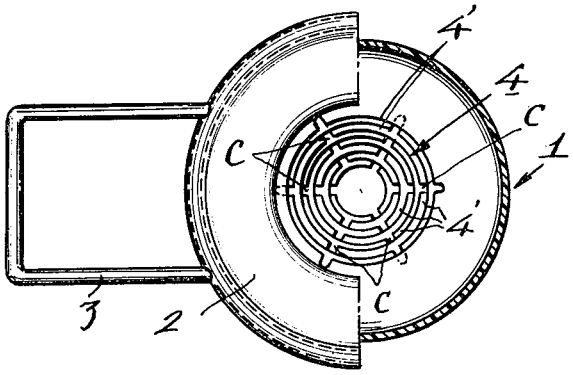
FIG. 1 is a top plan view of said urine disposal device with portion of said device broken away.
Figure 2:
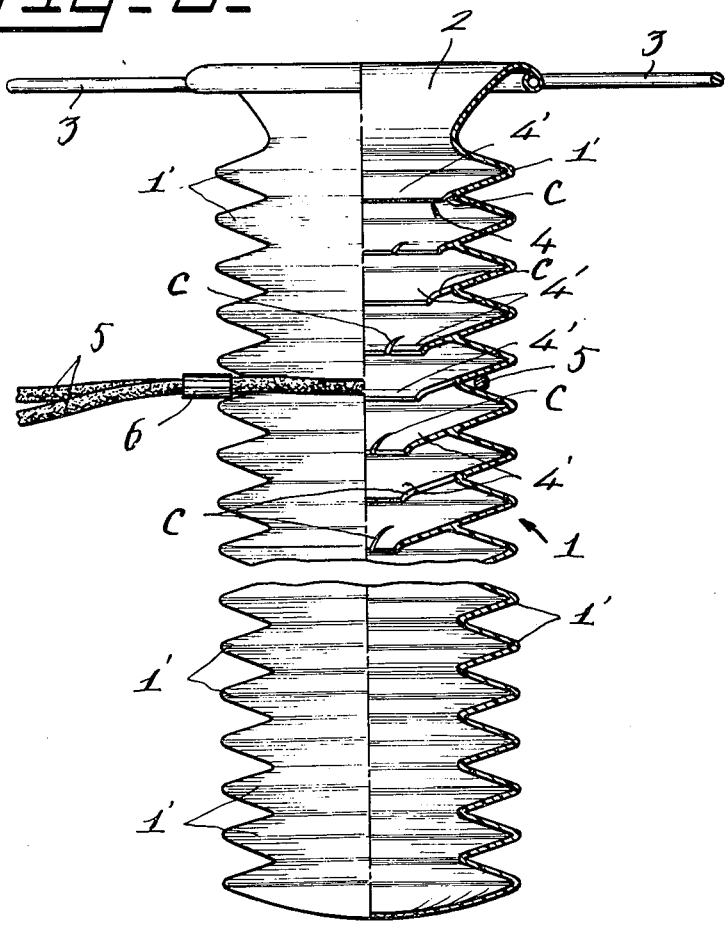
FIG. 2 is an elevational view of said urine disposal device showing one half of the device in vertical section.

The present invention will be now described referring to the accompanying drawing which shows one preferred embodiment of portable urine disposal device of the invention for illustration purpose only and the portable urine disposal device generally comprises a bellows-shaped main body which is generally shown by reference numeral 1 and which is formed of any suitable flexible material such as rubber or any pliable synthetic resin. The main body 1 is closed at the lower end and open at the upper end 2 which flares. The flared open upper end 2 of the main body 1 is provided on its periphery with diametrically opposite handles 3 which have a U-shape as seen in FIG. 1. A plurality of flexible annular members 4 formed of the same material as that for the main body 1 are provided within a substantial portion of the bellows-type main body 1 except for the upper end portion in the vicinity of the flared open end 2 and each of the annular members has a dish shape having the open bottom with the outer periphery of the member integrally connected to the reduced diameter inner periphery of the juncture between each two pleat units 1' of the plurality of pleat units which constitute the bellows of the main body 1. As shown in FIG. 2, the width of the annular members 4 gradually increases inwardly or downwardly toward the bottom of the main body and on other words, the diameter of the open bottoms or center openings of the annular members gradually reduces inwardly and downwardly toward the bottom of the main body. Each of the annular members 4 is split into a plurality of sectors 4' by means of a plurality of radially extending cuts C.

A binding string 5 is placed about the reduced diameter juncture between two selected pleat units 1' and a stopper ring 6 slidingly receives the two folded portions of the binding string 5 so that when the stopper ring 6 is manually pushed along the two folded portions of the binding string 5 in the bellows binding direction or toward and against the main body 1 until the main body is sealed after a quantity of urine has been received within the urine disposal device and the entire urine disposal device is carried to a place where the urine is disposed.

With the above construction and arrangement of the parts of the portable urine disposal device of the invention, when the device is not used, the device can be stored in a small space in its folded condition. In use, the device is carried to a desired place by the user and the user grips the handles 3 with his hands and slings the device from his hands whereupon the main body 1 is allowed to extend by its own weight by virtue of its bellows construction. Furthermore, since the annular members 4 are provided within the portion of the main body 1 adjacent to the flared upper end 2, when the user urinates with his penis positioned within the center openings or open bottoms of the annular members 4 or abutted against the walls of the openings, the urine can be effectively prevented from splashing out of the main body. And even if the urine disposal device is tilted somewhat after the device has received urine therein and before the binding string 5 is tightened, because of the presence of the annular members within the main body to define the coarctate areas where the urine is retained whereby the urine is effectively prevented from flowing out of the device even if the device is tilted somewhat with the upper end 2 left unsealed.

While only one embodiment of the invention has been shown and described in detail, it will be understood that the same is for illustration purpose only and not to be taken as a definition of the invention, reference being had for the purpose to the appended claims.

What is claimed is:

1. A portable urine disposal device comprising a flexible bellows-shaped main body having a closed bottom and a flared open upper end, a plurality of annular members each having the outer periphery integrally connected to the reduced diameter inner periphery of the juncture between each two adjacent pleat units of the upper portion of said bellows-shaped main body adjacent to said flared open end and a binding string placed about the outer periphery of one juncture between two selected pleat units of the bellows-shaped main body.

2. The portable urine disposal device as set forth in claim 1, further including a stopper ring in which the folded portions of said binding string are slidably received.

3. The portable urine disposal device as set forth in claim 1, in which said annular members have a dish shape having the open bottom or center opening.

4. The portable urine disposal device as set forth in claim 1, in which the width of said annular members gradually decreases toward said flared open upper end of the bellows-shaped main body and the diameter of the center openings of said annular members increases toward said flared open upper end of the bellows-shaped main body.

5. The portable urine disposal device as set forth in claim 1, in which said annular members are provided within the portion of said bellows-shaped main body in the vicinity of said flared open upper end of the main body to define coarctate urine retention areas in cooperation with the pleat units in said portion of the main body.

6. The portable urine disposal device as set forth in claim 1, in which said bellows-shaped main body and annular members are formed of rubber or pliable synthetic resin.

7. The portable urine disposal device as set forth in claim 1, further including a pair of diametrically opposite handles provided in the periphery of said flared open upper end of the main body.

8. The portable urine disposal device as set forth in claim 1, which each of said annular members comprises a plurality of sectors separated by radial cuts.

* * * * *